US010934734B1

(12) United States Patent
Al-Salloum et al.

(10) Patent No.: US 10,934,734 B1
(45) Date of Patent: Mar. 2, 2021

(54) DAMPED REINFORCED JOINT FOR BEAM-COLUMN CONNECTION

(71) Applicant: KING SAUD UNIVERSITY, Riyadh (SA)

(72) Inventors: Yousef A. Al-Salloum, Riyadh (SA); Husain Abbas, Riyadh (SA); Mohammad Alrubaidi, Riyadh (SA); Tarek H. Almusallam, Riyadh (SA); Hussein Mohamed Elsanadedy, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/797,991

(22) Filed: Feb. 21, 2020

(51) Int. Cl.
*E04H 9/02* (2006.01)
*E04H 9/04* (2006.01)
*E04B 1/24* (2006.01)

(52) U.S. Cl.
CPC ..... *E04H 9/021* (2013.01); *E04B 1/2403* (2013.01); *E04H 9/04* (2013.01); *E04B 2001/2445* (2013.01); *E04B 2001/2451* (2013.01); *E04H 9/02* (2013.01)

(58) Field of Classification Search
CPC ..... E04H 9/02; E04H 2009/026; E04H 1/985; E04H 9/024; E04H 9/027; E04H 9/028; E04H 9/21; E04H 9/04; E04B 1/98; E04B 1/2403; E04B 2001/2445; E04B 2001/2451
See application file for complete search history.

(56) References Cited

U.S. PATENT DOCUMENTS 980,480 A * 1/1911 Bishop ..... E04B 1/215 52/167.3
1,031,044 A * 7/1912 Conzelman ..... E04B 5/43 52/259
1,046,117 A * 12/1912 Skinner ..... E04B 5/40 52/250
2,786,349 A * 3/1957 Coff ..... E04B 1/22 52/223.4
3,513,609 A * 5/1970 Lang ..... E04C 5/08 52/223.6
3,867,805 A * 2/1975 Mikami ..... E04B 1/215 52/742.15

(Continued)

OTHER PUBLICATIONS

Lin et al., "Experimental Study of a Novel Multi-Hazard Resistant Prefabrication Concrete Frame Structure," Soil Dynamics and Earthquake Engineering, vol. 119, Apr. 2019, pp. 390-407.

*Primary Examiner* — Phi D A
(74) *Attorney, Agent, or Firm* — Nath, Goldberg & Meyer; Richard C. Litman

(57) ABSTRACT

A damped reinforced joint for a beam-column connection is provided for improving the resistance of steel-framed buildings against progressive collapse. Prestressing cables extend across each joint, and each prestressing cable is partially encased within a bent pipe. Each bent pipe may have multiple bends, forming a rippled or undulating shape. The prestressing cables strengthen the connections in the joints, and the bent pipes provide damping for dissipation of seismic energy and the like, thus improving resistance to earthquakes and other seismic, vibratory and/or shock events to the building frame.

17 Claims, 4 Drawing Sheets

(56) References Cited

U.S. PATENT DOCUMENTS

| | | | | |
|---|---|---|---|---|
| 4,630,412 | A * | 12/1986 | Engstrom | E04B 1/98 52/1 |
| 4,959,940 | A * | 10/1990 | Witschi | E04B 1/0038 52/583.1 |
| 5,675,943 | A * | 10/1997 | Southworth | E01D 19/00 52/167.1 |
| 6,397,528 | B1 | 6/2002 | Rahimian | |
| 6,438,905 | B2 | 8/2002 | Constantinou | |
| 6,647,678 | B1 * | 11/2003 | Zambelli | E04B 1/22 52/167.3 |
| 6,651,394 | B2 * | 11/2003 | Hughes | E04B 1/215 277/646 |
| 7,886,490 | B2 * | 2/2011 | Maekawa | E02D 5/808 52/223.14 |
| 8,146,301 | B2 | 4/2012 | Bystricky et al. | |
| 8,511,025 | B2 | 8/2013 | Kawai et al. | |
| 9,080,339 | B2 | 7/2015 | Hayes | |
| 9,567,763 | B2 | 2/2017 | Miyazawa et al. | |
| 9,745,741 | B2 | 8/2017 | Haynes | |
| 2002/0129568 | A1 | 9/2002 | Oka | |
| 2004/0065030 | A1 * | 4/2004 | Zambelli | E04C 5/0645 52/223.13 |
| 2006/0137288 | A1 | 6/2006 | Hulls et al. | |

* cited by examiner

DAMPED REINFORCED JOINT FOR BEAM-COLUMN CONNECTION

BACKGROUND

1. Field

The disclosure of the present patent application relates to structural joints, and particularly to a damped reinforced joint for a beam-column connection for improving the resistance of steel-framed buildings against progressive collapse, the damped reinforced joint combining prestressing cables and bent pipes which partially receive the prestressing cables to provide damping for dissipation of seismic energy and other sources of structural vibrations.

2. Description of the Related Art

Building frames, such as typical steel building frames, are often exposed to extreme load events, such as those caused by large wind forces, earthquake and blast loads. The ability of steel to yield under external forces is one of the reasons that steel is seen as an ideal building material for structural frames, however, steel buildings are still susceptible, under extreme conditions, to progressive collapse due to exposure to blast loads. The performance of steel-framed buildings primarily depends on the behavior of the frame's beam-column joints. The properties of the joints are crucial in a steel-framed building, since they determine the constructability, stability, strength, flexibility, residual forces, and ductility of the overall structure.

Progressive collapse is the propagation of an initial local failure from one part of the building to the adjoining parts, resulting in the eventual collapse of the entire building or, at least, large parts thereof. In order to resist progressive collapse of buildings, the "alternate path" method is typically employed in the design. In this method, alternate paths are available for load transfer if one critical component, such as a column, fails, thus preventing progressive collapse. If a column of a building frame fails (due to a blast or seismic forces, for example), steel-framed buildings should have well-defined redundancies so that alternative load paths are available via the formation of catenary action. Unfortunately, effective alternative load paths via catenary action are frequently lacking in present building designs.

Building frames commonly undergo vibrations under the action of large wind forces and earthquakes. These vibrations can range from harmless to severe, and the latter may cause serious structural damage and, in some cases, structural failure. Traditionally, in order to increase the stiffness of structures, the sizes of the structural members are increased to enhance the resistance to seismic loads. However, despite a significant increase in the cost of construction, the improvement in the safety level of the building is minimal. Although it is not possible to design buildings to completely avoid structural damage during earthquakes and strong winds, building vibrations can be reduced using structural controls. Current structural controls for suppressing structural vibrations are commonly in the form of hydraulic dampers. The performance of these dampers depends on the viscosity of the liquid, which deteriorates with the passage of time. It is clear that there is a great need to improve resistance against failure in the frame, as well as providing damping against earthquakes and other sources of vibration. Thus, a damped reinforced joint for a beam-column connection solving the aforementioned problems is desired.

SUMMARY

A damped reinforced joint for a beam-column connection is provided for improving the resistance of steel-framed buildings against progressive collapse, such as may be caused by damage to one or more columns as the result of exposure to blast loads or other extreme loads. The damped reinforcement may also be used to improve the resistance in reinforced concrete (RC). In one embodiment, in which the damped reinforced joint for a beam-column connection is used as an internal joint in the building frame, a first prestressing cable is provided having opposed first and second ends. The first and second ends thereof are respectively secured to first and second structural beams about a connection joint between the first and second structural beams and a structural column, where the first and second structural beams are positioned opposite one another with respect to the structural column. A first portion of the first prestressing cable is positioned adjacent the first structural beam, and a second portion of the first prestressing cable is positioned adjacent the second structural beam.

A second prestressing cable is also provided having opposed first and second ends, with the first and second ends thereof being respectively secured to the first and second structural beams about the connection joint between the first and second structural beams and the structural column. A first portion of the second prestressing cable is positioned adjacent the first structural beam, and a second portion of the second prestressing cable is positioned adjacent the second structural beam, A first bent pipe receives and partially covers the first portion of the first prestressing cable, and a second bent pipe receives and partially covers the second portion of the first prestressing cable. Similarly, a third bent pipe receives and partially covers the first portion of the second prestressing cable, and a fourth bent pipe receives and partially covers the second portion of the second prestressing cable.

First and second upper plates are provided, respectively having first and second upper holes formed therethrough. Similarly, first and second lower plates are also provided, respectively having first and second lower holes formed therethrough. The first and second upper plates are respectively secured to opposed sides of the structural column, and the first and second lower plates are also respectively secured to the opposed sides of the structural column such that the first and second upper plates are positioned above the first and second lower plates. A central portion of the first prestressing cable passes through the first and second upper holes of the first and second upper plates, respectively, to extend across the structural column, and a central portion of the second prestressing cable passes through the first and second lowerholes of the first and second lower plates, respectively, to also extend across the structural column.

Each of the first, second, third and fourth bent pipes may have multiple bends, forming a rippled or undulating shape. The first and second prestressing cables strengthen the connections in the joint, and the first, second, third and fourth bent pipes provide damping for dissipation of seismic energy and the like, thus improving resistance to earthquakes and other seismic, vibratory and/or shock events to the building frame, Similar fifth and sixth bent pipes may also be provided, such that the central portion of the first prestressing cable is at least partially received within the fifth bent pipe, and the central portion of the second prestressing cable is at least partially received within the sixth bent pipe. The fifth bent pipe and the sixth bent pipe are positioned between the opposed sides of the structural column.

In an alternative embodiment, in which the damped reinforced joint for a beam column connection is used as an external joint in the building frame, a first prestressing cable is provided having opposed first and second ends. The first end thereof is secured to a first side of a structural column, and the second end thereof is secured to a structural beam. The structural beam and the structural column are joined at a connection joint, with a first portion of the first prestressing cable extending between the first side of the structural column and an opposed second side thereof, and a second portion of the first prestressing cable being positioned adjacent the structural beam.

Similarly, a second prestressing cable is provided having opposed first and second ends, with the first end thereof being secured to the first side of the structural column, and the second end thereof being secured to the structural beam. A first portion of the second prestressing cable extends between the first and second sides of the structural column, and a second portion of the second prestressing cable is positioned adjacent the structural beam.

A first bent pipe receives and partially covers the second portion of the first prestressing cable, and a second bent pipe receives and partially covers the second portion of the second prestressing cable. Upper and lower connecting plates, having upper and lower holes respectively formed therethrough, are each secured to the second side of the structural column. The first prestressing cable passes through the upper hole of the upper connecting plate, and the second prestressing cable passes through the lower hole of the lower connecting plate.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
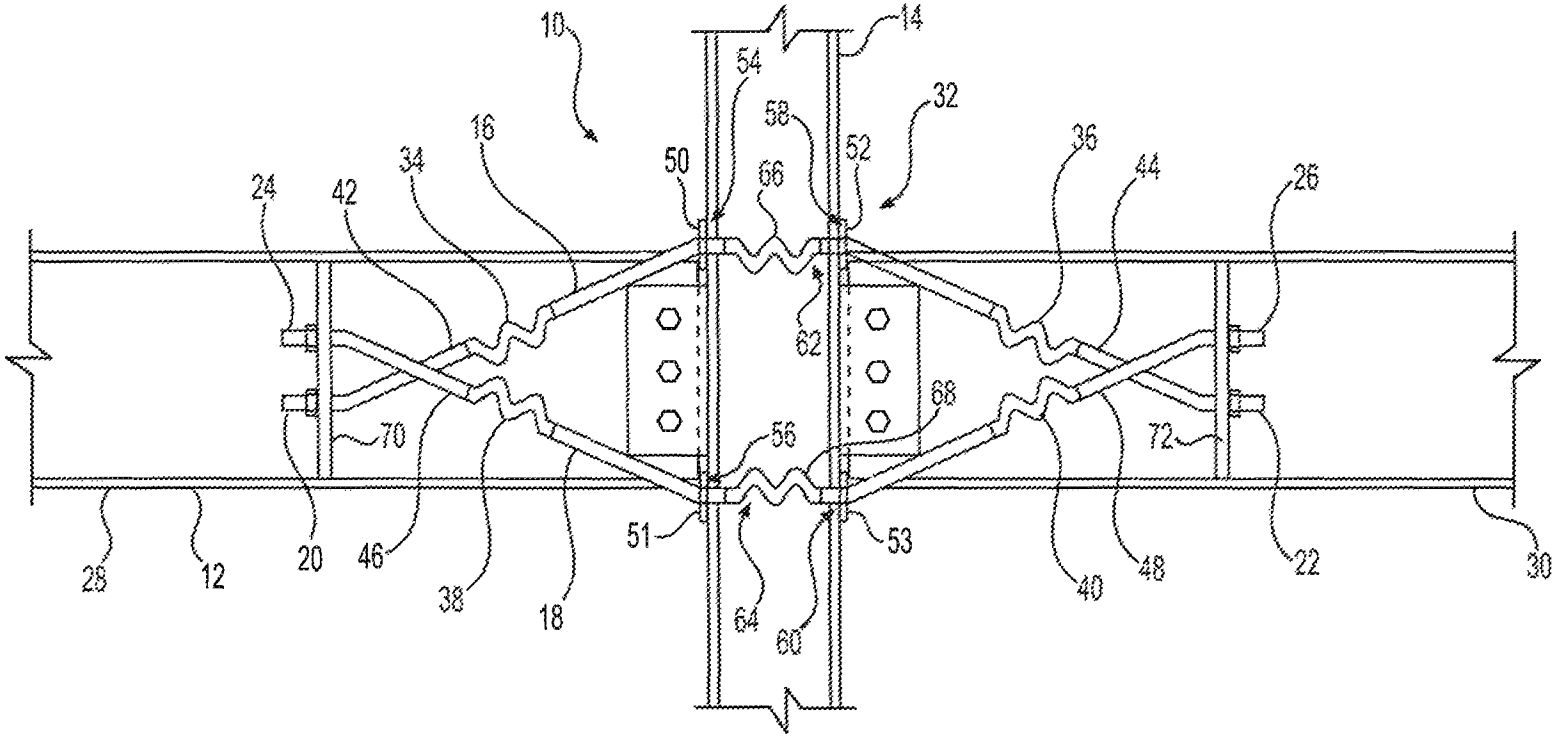
FIG. 1 is an elevational view of a damped reinforced joint for a beam-column connection.
Figure 3:
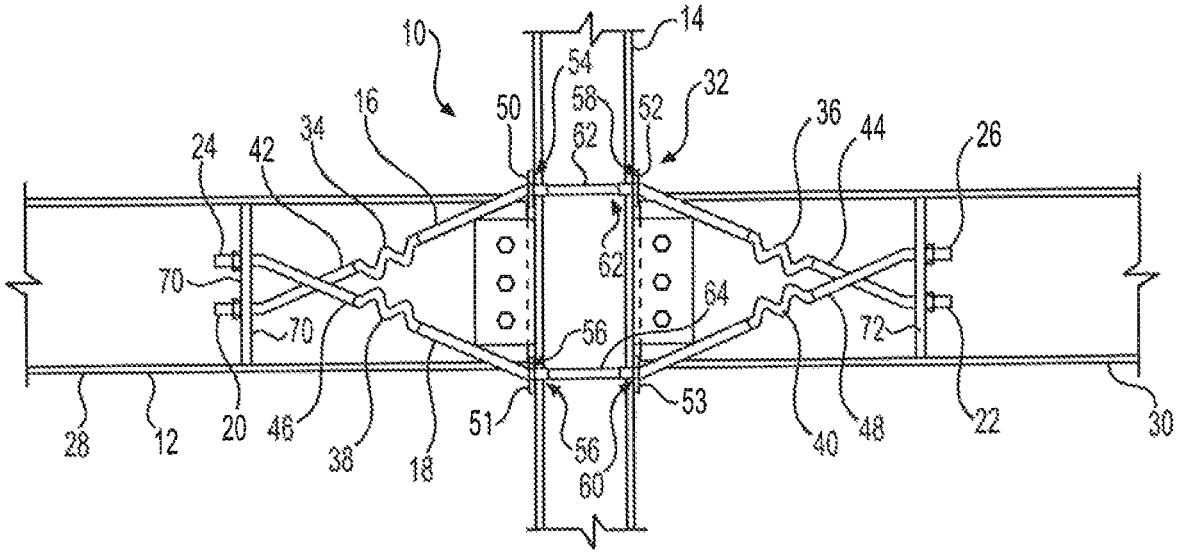
FIG. 3 is an elevational view of an alternative embodiment of the damped reinforced joint for beam-column connection.

Now referring to FIGS. 1 and 3, there is shown a damped reinforced joint for a beam-column connection 10, which is provided for improving the resistance of steel-framed buildings against progressive collapse, such as may be caused by damage to one or more columns as the result of exposure to blast loads or other extreme loads. The damped reinforcement may also be used to improve the resistance in reinforced concrete (RC), In the embodiments of FIGS. 1 and 3, in which the damped reinforced joint for a beam-column connection 10 is used as an internal joint in the building frame, a first prestressing cable 16 is provided having opposed first and second ends 20, 22, respectively. In this embodiment, each structural column 14 has a corresponding set of structural beams 12, consisting of first and second structural beams 28, 30, respectively, which are positioned opposite one another with respect to the structural column 14. The first and second ends 20, 22 of the first prestressing cable 16 are respectively secured to the first and second structural beams 28, 30 about a connection joint 32 between the first and second structural beams 28, 30 and the structural column 14. It should be understood that first and second structural beams 28, 30 and structural column 14 are shown for exemplary purposes only. As shown, a first portion 42 of the first prestressing cable 16 is positioned adjacent the first structural beam 28, and a second portion 44 of the first prestressing cable 16 is positioned adjacent the second structural beam 30.

A second prestressing cable 18 is also provided having opposed first and second ends 24, 26, respectively, with the first and second ends 24, 26 respectively secured to the first and second structural beams 28, 30 about the connection joint 32. A first portion 46 of the second prestressing cable 18 is positioned adjacent the first structural beam 28, and a second portion 48 of the second prestressing cable 18 is positioned adjacent the second structural beam 30. A first bent pipe 34 receives and partially covers the first portion 42 of the first prestressing cable 16, and a second bent pipe 36 receives and partially covers the second portion 44 of the first prestressing cable 16. Similarly, a third bent pipe 38 receives and partially covers the first portion 46 of the second prestressing cable 18, and a fourth bent pipe 40 receives and partially covers the second portion 48 of the second prestressing cable 18.

Figure 2:
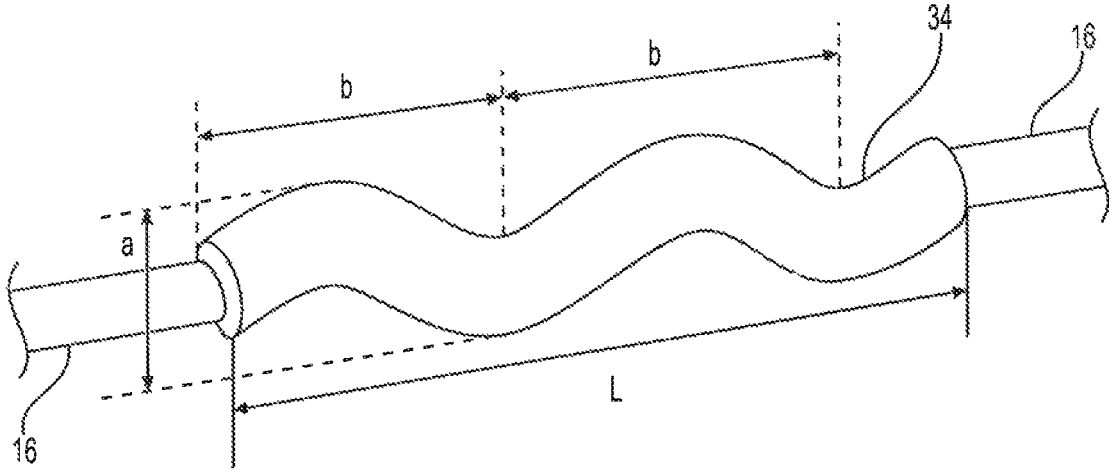
FIG. 2 is a perspective view showing a portion of a prestressing cable and a bent pipe of the damped reinforced joint for a beam-column connection.

FIG. 2 shows first bent pipe 34 with a portion of the first prestressing cable 16 passing therethrough. It should be understood that each of the bent pipes 34, 36, 38, 40 may be manufactured in a similar fashion. As shown, first bent pipe 34 has a plurality of bends, forming an undulating or rippled shape for providing elastic damping. Although first bent pipe 34 is shown in FIG. 2 as having a substantially sinusoidal contour, it should be understood that each of bent pipes 34, 36, 38, 40 may have any suitable shape, including at least one bend, for providing elastic damping for seismic and other vibratory forces.

The inner diameter of each pipe is preferably slightly larger (on the order of 2 mm to 10 mm) larger than the diameter of the corresponding prestressing cable. This should be neither too tight nor too loose rather it should be enough to accommodate the cable inside the rippled pipe. As noted above, although FIG. 2 illustrates a substantially sinusoidal shape for bent pipe 34, each bent pipe may have any suitable type of contouring, including, but not limited to, a triangular shape, a squared shape, a trapezoidal shape, a saw-tooth shape, or the like, each either with or without rounded corners. The pitch b, the depth a, the length L, the number of bends, the thickness of the bent pipe, and its mechanical properties may each be varied, dependent on the particular requirements of the building frame for resisting progressive collapse.

First and second upper plates 50, 52 are provided, respectively having first and second upper holes 54, 58 formed therethrough. Similarly, first and second lower plates 51, 53 are also provided, respectively having first and second lower holes 56, 60 formed therethrough. The first and second upper plates 50, 52 are respectively secured to opposed sides of the structural column 14, and the first and second lower plates 51, 53 are also respectively secured to the opposed sides of the structural column 14 such that the first and second upper plates 50, 52 are positioned above the first and second lower plates 51, 53, as shown. A central portion 62 of the first prestressing cable 16 passes through the first and second upper holes 54, 58 of the first and second upper plates 50, 52, respectively, to extend across the structural column 14, and a central portion 64 of the second prestressing cable 18 passes through the first and second lower holes 56, 60 of the first and second lower plates 51, 53, respectively, to also extend across the structural column 14.

The first and second prestressing cables 16, 18 strengthen the connections in the joint 32, and the bent pipes 34, 36, 38, 40 provide damping for dissipation of seismic energy and the like, thus improving resistance to earthquakes and other seismic, vibratory and/or shock events to the building frame. Further, as shown in FIG. 1, the central portion 62 of the first prestressing cable 16 is at least partially received within a fifth bent pipe 66, and the central portion 64 of the second prestressing cable 18 is at least partially received within a sixth bent pipe 68. The fifth and sixth bent pipes 66, 68 are each positioned between the opposed sides of the structural column 14. The fifth and sixth bent pipes 66, 68 may be configured similar to bent pipes 34, 36, 38, 40, as described above. Alternatively, as shown in the embodiment of FIG. 3, the central portion 62 of the first prestressing cable 16 and the central portion 64 of the second prestressing cable 18 may remain uncovered; i.e., in this embodiment, fifth and sixth bent pipes 66, 68, respectively, are not used.

Additionally, first and second mounting plates 70, 72 may be respectively secured to the first and second structural beams 28, 30, as shown in FIGS. 1 and 3. The first end 20 of the first prestressing cable 16 and the first end 24 of the second prestressing cable 18 are each secured to the first mounting plate by bolts or the like. Similarly, the second end 22 of the first prestressing cable 16 and the second end 26 of the second prestressing cable 18 are secured to the second mounting plate 72. First and second mounting plates 70, 72 may be stiffener plates, extending between the flanges or webs of first and second structural beams 28, 30, and may be secured thereto by welding or the like.

In the exemplary orientation shown in FIGS. 1 and 3, the central portion 62 of the first prestressing cable 16 is positioned above the central portion 64 of the second prestressing cable 18. Additionally, in this exemplary orientation and configuration, the respective first portions 42, 46 of the first and second prestressing cables 16, 18 cross such that the first end 20 of the first prestressing cable 16 is positioned beneath the first end 24 of the second prestressing cable 18. Similarly, the respective second portions 44, 48 of the first and second prestressing cables 16, 18 cross such that the second end 22 of the first prestressing cable 16 is positioned beneath the second end 26 of the second prestressing cable 18.

Figure 5:
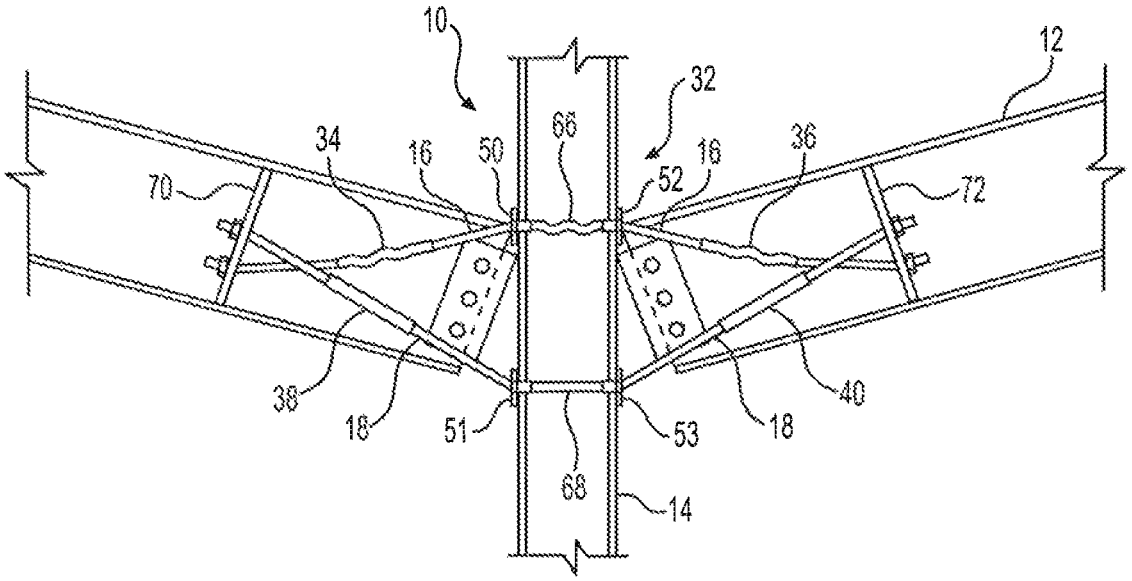
FIG. 5 illustrates an exemplary extreme load scenario taking place in the damped reinforced joint for a beam-column connection of FIG. 1, FIG. 6 diagrammatically illustrates the exemplary extreme load scenario of FIG. 5.

It should be understood that FIGS. 1 and 3 only show a single side or face of the joint 32. It should be understood that a similar connecting structure (including a second pair of prestressing cables) may be used on the opposed side or face of the joint 32. FIG. 5 illustrates an exemplary extreme load scenario, where the beam-column joint 32 at the upper end of the damaged structural column moves downward, which causes the prestressing cables 16, 18 to stretch. As each prestressing cable 16, 18 passes through its respective bent pipes, the bent pipes tend to straighten under the force of tension. In the exemplary scenario of FIG. 5, third, fourth and sixth bent pipes 38, 40, 68 corresponding to the second prestressing cable 18 experience a much greater straightening force, as shown, and this straightening permits considerable downward movement of the joint 32 (after the failure of the bolts connecting the set of structural beams 12 to the structural column 14 through plates 50, 52) before the cables get stressed. The resistance provided by the damped reinforced joint 10 is low in the beginning and increases with the increase in the downward movement. This helps in restraining the downward movement by connecting the set of structural beams 12 across the damaged joint 32, thus developing catenary action in the set of structural beams 12. The presence of the bent pipes avoids sudden rupture of the prestressing cables. Although this example shows a typical beam-column connection, it should be understood that the damped reinforced joint 10 may be used with any suitable type of steel beam-column connections, such as simple (pinned) connections, semi-rigid connections, and moment connections.

Figure 6:
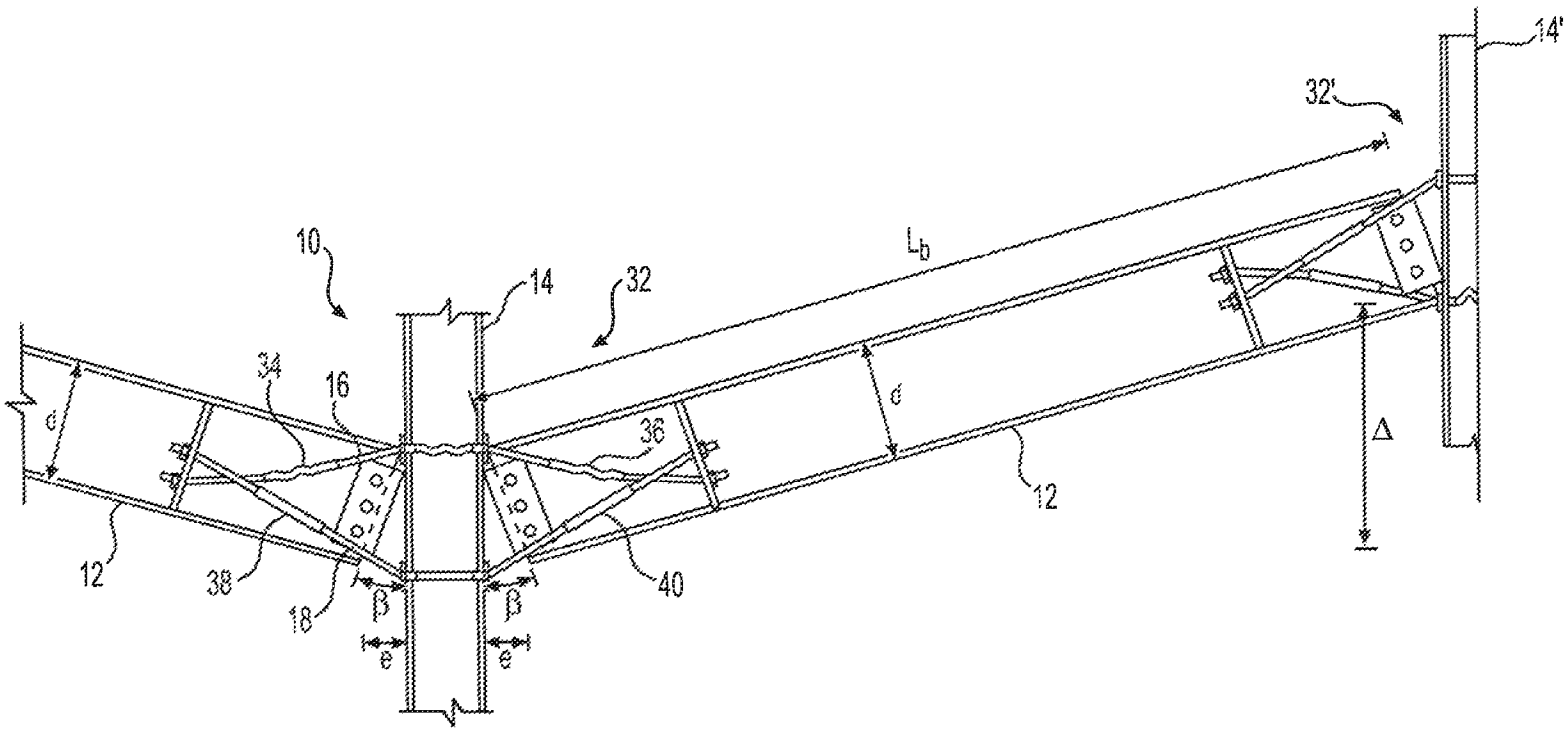

FIG. 6 illustrates the vertical deflection $\Delta$ of a beam-column connection due to the damage of a structural column 14 because of an extreme load scenario, similar to that described above with regard to FIG. 5. Here, a second joint 32' formed with an adjacent structural column 14' is also shown. Rotation of the set of structural beam(s) 12, $\beta$, is approximately $\beta \cong \Delta/L_b$. This assumes that beam 12 remains straight and, thus, the actual value of angle $\beta$ will be less. The downward vertical movement of joint 32 causes stretching of the cables 16, 18 and, hence, the straightening of the bent pipes at the connection of the damaged column 14. The extension of the cables due to the straightening of the bent pipes is equal to the opening of joint 32 at the bottom level of the beam 12, which can be approximately calculated from $2e \cong 2\beta d \cong 2d\Delta/L_b$, where d is the depth of the beam, $L_b$ is the length of the beam, and e is the extension.

However, a better estimate for e can be obtained from a structural analysis. With the angle $\beta$ being on higher side, the stretching described above can also be on the higher side. A maximum deflection of $\Delta = kd$ can be resisted by the steel beam-column connection, where k varies from 1 to 2 depending on the type of connection, members, and material characteristics. As the span to depth ratio for steel framed beams varies from 16 to 24, the value of 2e may vary from d/10 to d/4. The numbers, amplitudes, and shapes of the bends in the bent pipes can be selected such that the cumulative straightening of the bent pipes causes an extension of magnitude equal to 2e. The damped reinforced joint can start taking the load even before the total failure of the joint. This is because the bent pipes start taking the load right from the initiation of straightening of the bends, but initially the resistance provided is low. However, the resistance provided by the damped reinforced joint 10 becomes considerable as the downward movement of joint increases. The resistance provided by the damped reinforced joint 10 will hold further downward movement of the joint, thus preventing progressive collapse of the building.

A similar system may be used for energy dissipation in building frames during seismic excitation. By using similar prestressing cables in bent pipes as diagonal members in outer building frames, the prestressing cables will be stressed 5%-25% of the yield stress. During an earthquake, the lateral building sway will cause elongation in one of the diagonal members, which will cause stretching of the bent pipes. The resistance offered by this system will increase with the increase in the lateral displacement, and recover fully when the direction of lateral displacement is reversed.

In order to form joint 32, the first and second prestressing cables 16, 18 are first passed through fifth and sixth bent pipes 66, 68, respectively. First and second mounting plates 70, 72, respectively, are then welded to first and second structural beams 28, 30, and, first and second plates 50, 52 are secured to both first and second structural beams 28, 30 and structural column 14. The first prestressing cable 16 is then passed through first holes 54, 66, and the second prestressing cable 18 is passed through second holes 56, 60. First prestressing cable 16 is then received by first and second bent pipes 34, 36, and the first and second ends 20, 22 thereof are respectively anchored to mounting plates 70, 72, Similarly, second prestressing cable 18 is received by third and fourth bent pipes 38, 40, and the first and second ends 24, 26 thereof are respectively anchored to mounting plates 70, 72. The first and second prestressing cables 16, 18 are stressed to about 5%-25% of the yield stress. This initial stressing keeps the system in position under service loads. In the embodiment of FIG. 3, in which fifth and sixth bent pipes 66, 68 are not used, the first and second prestressing cables 16, 18 are stressed to about 5%-20% of the yield stress.

Figure 4:
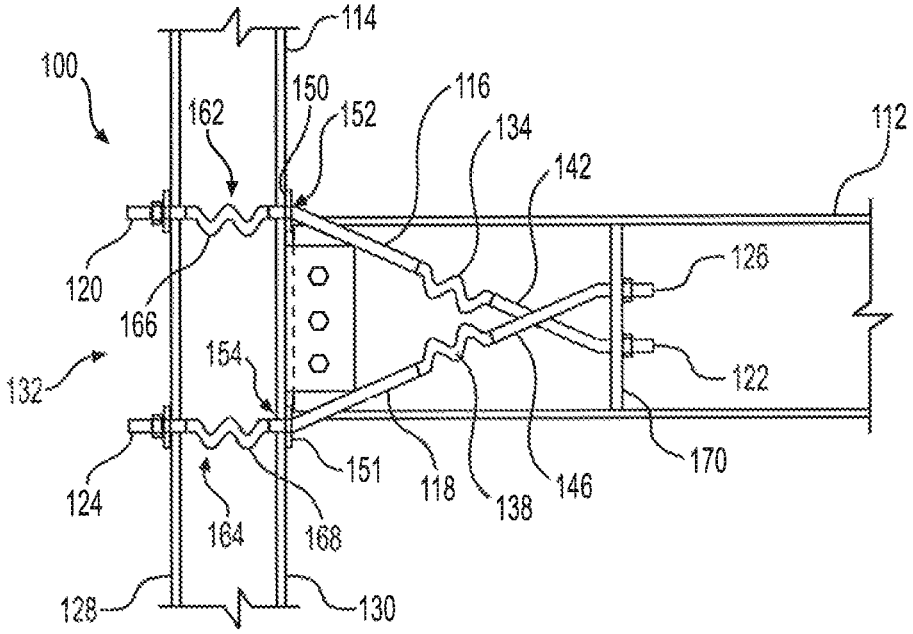
FIG. 4 is an elevational view of another alternative embodiment of the damped reinforced joint for beam-column connection.

In the alternative embodiment of FIG. 4, the damped reinforced joint for a beam-column connection 100 is used as an external joint in the building frame. In this embodiment, a first prestressing cable 116 is provided having opposed first and second ends 120, 122, respectively. The first end 120 is secured to a first side 128 of a structural column 114, and the second end 122 is secured to a structural beam 112, The structural beam 112 and the structural column 114 are joined at a connection joint 132, with a first portion 162 of the first prestressing cable 116 extending between the first side 128 of the structural column 114 and an opposed second side 130 thereof, and a second portion 142 of the first prestressing 116 cable positioned adjacent the structural beam 112.

Similarly, a second prestressing cable 118 is provided having opposed first and second ends 124, 126, respectively, with the first end 124 secured to the first side 128 of the structural column 114 by a bolt or the like, and the second end 126 being secured to the structural beam 112. A first portion 164 of the second prestressing cable 118 extends between the first and second sides 128, 130 of the structural column 114, and a second portion 146 of the second prestressing cable 118 is positioned adjacent the structural beam 112.

A first bent pipe 134 receives and partially covers the second portion 142 of the first prestressing cable 116, and a second bent pipe 138 receives and partially covers the second portion 146 of the second prestressing cable 118. First and second bent pipes 134, 138 may be similar in construction to the bent pipes of the previous embodiments. Additionally, similar to the previous embodiments, upper and lower connecting plates 150, 151, having upper and lower holes 152, 154 respectively formed therethrough, are each secured to the second side 130 of the structural column 114, The first prestressing cable 116 passes through the upper hole 152 of the upper connecting plate 150, and the second prestressing cable 118 passes through the lower hole 154 of the lower connecting plate 151.

Similar to the embodiment of FIG. 3, first portions 162, 164 of first and second prestressing cables 116, 118, respectively, may be uncovered. Alternatively, as shown in FIG. 4, first portion 162 of first prestressing cable 116 may be received by a third bent pipe 166, and first portion 164 of second prestressing cable 118 may be received by a fourth bent pipe 168. It should be understood that third and fourth bent pipes 166, 168 may be similar in construction to first and second bent pipes 134, 138.

Additionally, similar to the previous embodiments, a mounting plate 170 may be secured to the structural beam 112, such that the respective second ends 122, 1.26 of the first and second prestressing cables 116, 118 may be secured thereto by bolts or the like. In the exemplary orientation and configuration of FIG. 4, the first portion 162 of the first prestressing cable 116 is positioned above the first portion 164 of the second prestressing cable 118. Similar to the previous embodiments, the respective second portions 142, 146 of the first and second prestressing cables 116, 118 may cross such that the second end 122 of the first prestressing cable 116 is positioned beneath the second end 126 of the second prestressing cable 118. Mounting plate 170 may be a stiffener plate, extending between the flanges or webs of structural beam 112, and may be secured thereto by welding or the like.

In order to form joint 132, the first and second prestressing cables 116, 118 are first passed through third and fourth bent pipes 166, 168, respectively. Mounting plate 170 is then welded to structural beam 112, and connecting plate 150 is secured to both structural beam 112 and structural column 114. The first prestressing cable 116 is then passed through first hole 152, and the second prestressing cable 118 is passed through second hole 154. The first ends 120, 124 thereof are anchored to first side 128 of structural column 114 by bolts or the like. The first prestressing cable 116 is then received by first bent pipe 134, and the second end 122 thereof is anchored to mounting plate 170, Similarly, second prestressing cable 118 is received by second bent pipe 138, and the second end 126 thereof is anchored to mounting plate 170. After stressing, the first and second prestressing cables 116, 118 are stressed to about 5%-20% of the yield stress. This initial stressing keeps the system in position under service loads. As discussed above, the third and fourth bent pipes 166, 168 do not have to be used. In this alternative, the first and second prestressing cables 16, 18 are also stressed to about 5%-20% of the yield stress. It should be understood that FIG. 4 only shows a single side or face of the joint 132. It should be understood that a similar connecting structure (including a second pair of prestressing cables) may be used on the opposed side or face of the joint 132.

It is to be understood that the damped reinforced joint for a beam-column connection is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A damped reinforced joint for a beam-column connection, comprising:

a first prestressing cable having opposed first and second ends, the first and second ends thereof being respectively secured to first and second structural beams about a connection joint between the first and second structural beams and a structural column, where the first and second structural beams are positioned opposite one another with respect to the structural column, a first portion of the first prestressing cable being positioned adjacent the first structural beam, and a second portion of the first prestressing cable being positioned adjacent the second structural beam;

a second prestressing cable having opposed first and second ends, the first and second ends thereof being respectively secured to the first and second structural beams about the connection joint between the first and second structural beams and the structural column, a first portion of the second prestressing cable being positioned adjacent the first structural beam, and a second portion of the second prestressing cable being positioned adjacent the second structural beam;

a first bent pipe receiving and partially covering the first portion of the first prestressing cable;

a second bent pipe receiving and partially covering the second portion of the first prestressing cable;

a third bent pipe receiving and partially covering the first portion of the second prestressing cable;

a fourth bent pipe receiving and partially covering the second portion of the second prestressing cable; and first and second upper plates respectively having first and second upper holes formed therethrough;

first and second lower plates respectively having first and second lower holes formed therethrough, wherein the first and second upper plates are respectively secured to opposed sides of the structural column, and the first and second lower plates are respectively secured to the opposed sides of the structural column such that the first and second upper plates are positioned above the first and second lower plates, a central portion of the first prestressing cable passes through the first and second upper holes of the first and second upper plates, respectively, to extend across the structural column, and a central portion of the second prestressing cable passes through the first and second lower holes of the first and second lower plates, respectively, to extend across the structural column; and first and second mounting plates respectively secured to the first and second structural beams, the first end of the first prestressing cable and the first end of the second prestressing cable being secured to the first mounting plate, and the second end of the first prestressing cable and the second end of the second prestressing cable being secured to the second mounting plate, wherein each of the first, second, third and fourth bent pipes is located adjacent their corresponding first and second portions of the first and second prestressing cable.

2. The damped reinforced joint for a beam-column connection as recited in claim 1, wherein the central portion of the first prestressing cable is positioned above the central portion of the second prestressing cable, and wherein the respective first portions of the first and second prestressing cables cross such that the first end of the first prestressing cable is positioned beneath the first end of the second prestressing cable, and wherein the respective second portions of the first and second prestressing cables cross such that the second end of the first prestressing cable is positioned beneath the second end of the second prestressing cable.

3. The damped reinforced joint for a beam-column connection as recited in claim 1, wherein each of the first, second, third and fourth bent pipes has a plurality of bends.

4. The damped reinforced joint for a beam-column connection as recited in claim 3, wherein each of the first, second, third and fourth bent pipes has a sinusoidal shape.

5. The damped reinforced joint for a beam-column connection as recited in claim 1, further comprising fifth and sixth bent pipes, the central portion of the first prestressing cable being at least partially received within the fifth bent pipe, and the central portion of the second prestressing cable being at least partially received within the sixth bent pipe, the fifth and sixth bent pipes being positioned between the opposed sides of the structural column.

6. The damped reinforced joint for a beam-column connection as recited in claim 5, wherein each of the fifth and sixth bent pipes has a plurality of bends.

7. The damped reinforced joint for a beam-column connection as recited in claim 6, wherein each of the fifth and sixth bent pipes has a sinusoidal shape.

8. A damped reinforced joint for a beam-column connection, comprising:

a first prestressing cable having opposed first and second ends, the first end thereof being secured to a first side of a structural column, the second end thereof being secured to a structural beam, the structural beam and the structural column being joined at a connection joint, a first portion of the first prestressing cable extending between the first side of the structural column and an opposed second side thereof, and a second portion of the first prestressing cable being positioned adjacent the structural beam, wherein the first portion of the first prestressing cable is positioned above the first portion of the second prestressing cable, wherein the respective second portions of the first and second prestressing cables cross such that the second end of the first prestressing cable is positioned beneath the second end of the second prestressing cable;

a second prestressing cable having opposed first and second ends, the first end thereof being secured to the first side of the structural column, the second end thereof being secured to the structural beam, a first portion of the second prestressing cable extending between the first and second sides of the structural column, and a second portion of the second prestressing cable being positioned adjacent the structural beam;

a first bent pipe receiving and partially covering the second portion of the first prestressing cable;

a second bent pipe receiving and partially covering the second portion of the second prestressing cable;

upper and lower connecting plates having upper and lower holes respectively formed therethrough, the upper and lower connecting plates being secured to the second side of the structural column, wherein the first prestressing cable passes through the upper hole of the upper connecting plate, and the second prestressing cable passes through the lower hole of the lower connecting plate; and a mounting plate secured to the structural beam, the respective second ends of the first and second prestressing cables being secured to the mounting plate.

9. The damped reinforced joint for a beam-column connection as recited in claim 8, wherein each of the first and second bent pipes has a plurality of bends.

10. The damped reinforced joint for a beam-column connection as recited in claim 9, wherein each of the first and second bent pipes has a sinusoidal shape.

11. The damped reinforced joint for a beam-column connection as recited in claim 8, further comprising third and fourth bent pipes, the first portion of the first prestressing cable being at least partially received within the third bent pipe, and the first portion of the second prestressing cable being at least partially received within the fourth bent pipe, the third and fourth bent pipes being positioned between the first and second sides of the structural column.

12. The damped reinforced joint for a beam-column connection as recited in claim 11, wherein each of the third and fourth bent pipes has a plurality of bends.

13. The damped reinforced joint for a beam-column connection as recited in claim 12, wherein each of the third and fourth bent pipes has a sinusoidal shape.

14. A structural frame for a building having damped reinforced joints for beam-column connections, comprising:

at least one structural beam set, the at least one structural beam set comprising at least first and second structural beams;

at least one structural column connected to the first and second structural beams of the at least one structural beam set at at least one connection joint;

at least one first prestressing cable having opposed first and second ends, the first and second ends thereof being respectively secured to the first and second structural beams about the at least one connection joint, a first portion of the at least one first prestressing cable being positioned adjacent the first structural beam, and a second portion of the at least one first prestressing cable being positioned adjacent the second structural beam;

at least one second prestressing cable having opposed first and second ends, the first and second ends thereof being respectively secured to the first and second structural beams about the at least one connection joint, a first portion of the at least one second prestressing cable being positioned adjacent the first structural beam, and a second portion of the at least one second prestressing cable being positioned adjacent the second structural beam;

at least one first bent pipe receiving and partially covering the first portion of the at least one first prestressing cable;

at least one second bent pipe receiving and partially covering the second portion of the at least one first prestressing cable;

at least one third bent pipe receiving and partially covering the first portion of the at least one second prestressing cable;

at least one fourth bent pipe receiving and partially covering the second portion of the at least one second prestressing cable; and at least one first upper plate and at least one second upper plate respectively having first and second upper holes formed therethrough;

at least one first lower plate and at least one second lower plate respectively having first and second lower holes formed therethrough, wherein the at least one first and second upper plates are respectively secured to opposed sides of the at least one structural column, and the at least one first and second lower plates are respectively secured to the opposed sides of the at least one structural column such that the at least one first and second upper plates are positioned above the at least one first and second lower plates, a central portion of the at least one first prestressing cable passes through the first and second upper holes of the at least one first and second upper plates, respectively, to extend across the at least one structural column, and a central portion of the at least one second prestressing cable passes through the first and second lower holes of the at least one first and second lower plates, respectively, to extend across the at least one structural column.

15. The structural frame for a building having damped reinforced joints for beam-column connections as recited in claim 14, further comprising first and second mounting plates respectively secured to the first and second structural beams, the first end of the at least one first prestressing cable and the first end of the at least one second prestressing cable being secured to the first mounting plate, and the second end of the at least one first prestressing cable and the second end of the at least one second prestressing cable being secured to the second mounting plate.

16. The structural frame for a building having damped reinforced joints for beam-column connections as recited in claim 15, wherein the central portion of the at least one first prestressing cable is positioned above the central portion of the at least one second prestressing cable, and wherein the respective first portions of the at least one first prestressing cable and the at least one second prestressing cable cross such that the first end of the at least one first prestressing cable is positioned beneath the first end of the at least one second prestressing cable, and wherein the respective second portions of the at least one first prestressing cable and the at least one second prestressing cable cross such that the second end of the at least one first prestressing cable is positioned beneath the second end of the at least one second prestressing cable.

17. The structural frame for a building having damped reinforced joints for beam-column connections as recited in claim 14, further comprising at least one fifth bent pipe and at least one sixth bent pipe, the central portion of the at least one first prestressing cable being at least partially received within the at least one fifth bent pipe, and the central portion of the at least one second prestressing cable being at least partially received within the at least one sixth bent pipe, the at least one fifth bent pipe and the at least one sixth bent pipe being positioned between the opposed sides of the at least one structural column.

* * * * *